United States Patent [19]

Asari et al.

[11] Patent Number: 4,891,601

[45] Date of Patent: Jan. 2, 1990

[54] RADIO FREQUENCY MULTIPOLE LINEAR ACCELERATOR

[75] Inventors: Masatoshi Asari, Uji; Ikuo Konishi; Hiroyuki Fujita, both of Takatsuki; Akira Hirakimoto, Kyoto; Hiroaki Nakanishi, Ohtsu, all of Japan

[73] Assignee: Shimadzu Corporation, Osaka, Japan

[21] Appl. No.: 277,192

[22] Filed: Nov. 29, 1988

[30] Foreign Application Priority Data

Dec. 21, 1987 [JP] Japan ..... 62-194185[U]
Feb. 5, 1988 [JP] Japan ..... 63-14745[U]

[51] Int. Cl.[4] ..... H05H 9/00

[52] U.S. Cl. ..... 328/233; 313/147; 313/146

[58] Field of Search ..... 313/146, 147; 328/233

[56] References Cited

U.S. PATENT DOCUMENTS 4,485,346 11/1984 Swenson et al. ..... 328/233

*Primary Examiner*—Kenneth Wieder

*Attorney, Agent, or Firm*—Koda & Androlia

[57] ABSTRACT

In a multipole linear accelerator such as of a quadrupole type, fine positional adjustment of the tip portions of the electrodes constituting the multipole structure can be made with electric contact kept substantially unaffected between the electrodes and the cavity drum in which the electrodes are mounted. Each of the electrodes are provided with a series of contact plates on both sides of the root portion of the electrode over the whole length thereof. Each of the contact plates, which are held to the root portion of the electrode by means of an adjusting screw bolt, slantwise bridges the root portion of the electrode and the inner surface of the cavity drum with elastic contact pieces interposed. Tightening or loosing the adjusting screw bolts on both sides of the electrode displaces the electrode with electric contact kept unchanged between the electrode and the cavity drum by the elastic effect of the above contact pieces made to interpose between the contact plates and both the electrodes and the cavity drum.

6 Claims, 4 Drawing Sheets

FIG. 1
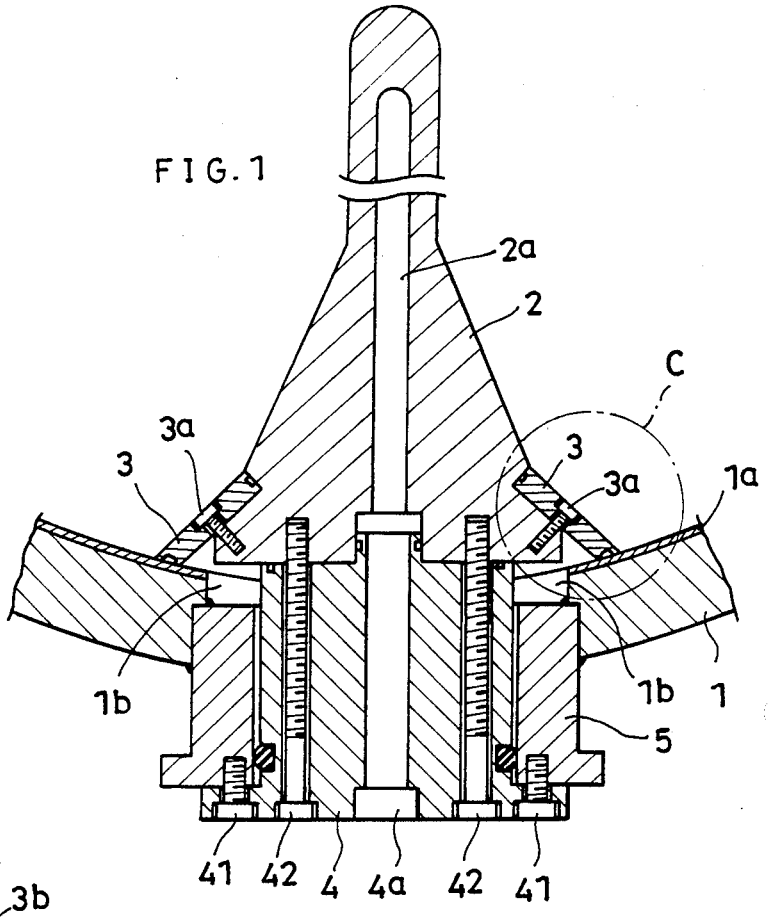
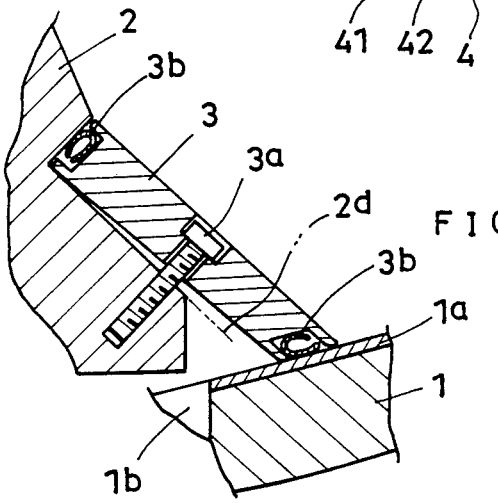
FIG. 2

RADIO FREQUENCY MULTIPOLE LINEAR ACCELERATOR

BACKGROUND OF THE INVENTION

The present invention relates to a radio frequency multipole linear accelerator.

The basic constitution and function of radio frequency multipole linear accelerators can be briefed as follows by exemplifying a quadrupole linear accelerator, which is the sole type that has hitherto been practiced of the radio frequency multipole type linear accelerators. The radio frequency quadrupole linear accelerator is substantially equivalent to a radio frequency resonant cavity of a specific type. The resonant cavity fundamentally consists of a cylindrical cavity drum and four electrodes enclosed therein. The four electrodes, which are prolonged in the direction parallel to the axis of the cavity drum, have their root portions fixed (both mechanically and electrically) to the inner surface of the cavity drum at angular intervals of 90°, so that their tip portions, viewed cross-sectionally, may form a quadrupole configuration with the axis put in accordance with that of the cavity drum. Further, the four electrodes have their tips wave-formed along the length direction. With an electromagnetic standing wave, for example, of TE210 mode made developed in the cavity having such a constitution as described above, there is produced in the space around and in the vicinity of the cavity axis an electric field having two components: one component, which is axial along the cavity axis, acts so as to accelerate charged particles along the cavity axis; and the other, which is radial, acts so as to make the particles converge around the axis. Thus the cavity, with traveling charged particles introduced thereto through the particle inlet hole on one of the cavity walls, accelerates the charged particles with the same kept bunched.

In such a principle the effectual performance of bunched acceleration of particles largely depends, in practice, on the precision of the relative arrangement of the electrodes, especially with respect to their tip portions. Therefore, it is practical to provide some means for fine adjusting the position of the tip portion of electrode. Such adjusting means has conventionally been practiced, for example, by a mechanism as illustrated in FIG. 7.

According to FIG. 7, which shows a partial cross-sectional view (in which only one electrode is shown) of a conventional resonant cavity of the quadrupole type radio frequency linear accelerator, each one of the four electrodes 72 is mounted in a cavity drum 71 through a electrode supporting element 75 fixed directly to the cavity drum 71 by means of a positioning pin 76 and a screw bolt 78. The electrode 72 is secured to the electrode supporting element 75 by a positioning pin 77 and an adjusting screw bolt 73. The electric contact between the electrode 72 and the cavity drum 71 is kept predominantly through contact elements 74 interposed between the root portions on both sides of the electrodes 72 and the inner surface of the cavity drum 71. The contact elements are made of an electroconductive elastic materials. In such a constitution of electrode mounting, the fine positional adjustment of the electrode tip portion is effected by adjusting the tilt of the electrode 72 through driving the adjusting screw bolt 73.

The above method of adjusting the position of the electrode tip portion is, however, accompanied by an important disadvantage that the tilting of the electrode 72 influences the contact pressure on the contact elements 74, resulting in the variation of the contact resistance between the electrode 72 and the cavity drum 71 and, therefore, causing the quality factor (Q-value) of the cavity to vary. It is essentially important that the cavity should be operated at a constant high Q-value without being affected by any fine positional adjustment of the electrodes.

OBJECTS AND SUMMARY OF THE INVENTION

The present invention aims at eliminating the above mentioned disadvatage from the mechanism of electrode adjustment, and makes it an object to provide an improved radio frequency multipole linear accelerator having electrode adjusting means substantially free from affecting an originally achieved high Q-value of the resonant cavity during the fine positional adjustment of the electodes.

Another object of the present invention is to actualize such an improved accelerator in a simple way without making any substantial alterations to the fundamental design of the conventional radio frequency multipole linear accelerator.

To achieve the above objects, in one embodiment of the invention, each of the electrodes mounted in a cavity drum has its root portions on both sides accompanied by a series of contact elements arranged over the whole length of the electrode. The contact elements slantwise interpose between the electrode root portions and the inner surface of the cavity drum in a brace-like form, and are connected to the electrode root portions by means of adjusting screw bolts with clearance left therebetween so that, by tightening the adjusting screw bolts on one side with those on the other side loosened, the electrode root portion can be pulled up unevenly. The contact elements are further provided with electroconducting elastic contact elements at their edges to keep in touch with the electrode root portions and the cavity drum. With the above mentioned arrangement and constitution of the electrode tilting plates, the tip position of each electrode can be fine adjusted substantially over the whole length of the electrode by driving the adjusting screw bolts and, in addition, the electric contact between the electrode and the cavity drum is not influenced by the electrode tip adjustment because of the elasticity of the electroconductive elastic contact elements provided to the electrode contact plates.

In another embodiment of the invention, the electrode tip position adjusting means is somewhat similar to that mentioned previously in conjunction with a conventional radio frequency quadrupole linear accelerator. The adjustment is effected by means of an external adjusting screw bolt keeping in touch with the bottom face of the electrode through the electrode supporting element. In this embodiment, however, major electric contact between the electrode and the cavity drum is achieved by a pair of series contact blocks keeping in touch with the root portions on both sides of the electrode and with the inner surface of the cavity drum through contact element made of an electroconductive elastic material. The contact blocks are provided with their respective adjusting screw bolts by which the contact blocks can be kept pressed securely against both the electrode and the cavity drum. In this way the electric contact between the electrode and the cavity drum, and therefore, the Q-value of the resonant cavity is safe from being influenced by the fine positional adjustment of the electrode tip portion.

BRIEF DESCRIPTION OF THE DRAWINGS

In the following the present invention is described in further detail on reference to the accompanying drawings, in which:

FIG. 1 shows a partial cross-sectional view of a first embodiment of the present invention;

FIG. 2 shows a partial enlargement of FIG. 1;

DETAILED DESCRIPTION OF THE INVENTION

Figure 4:
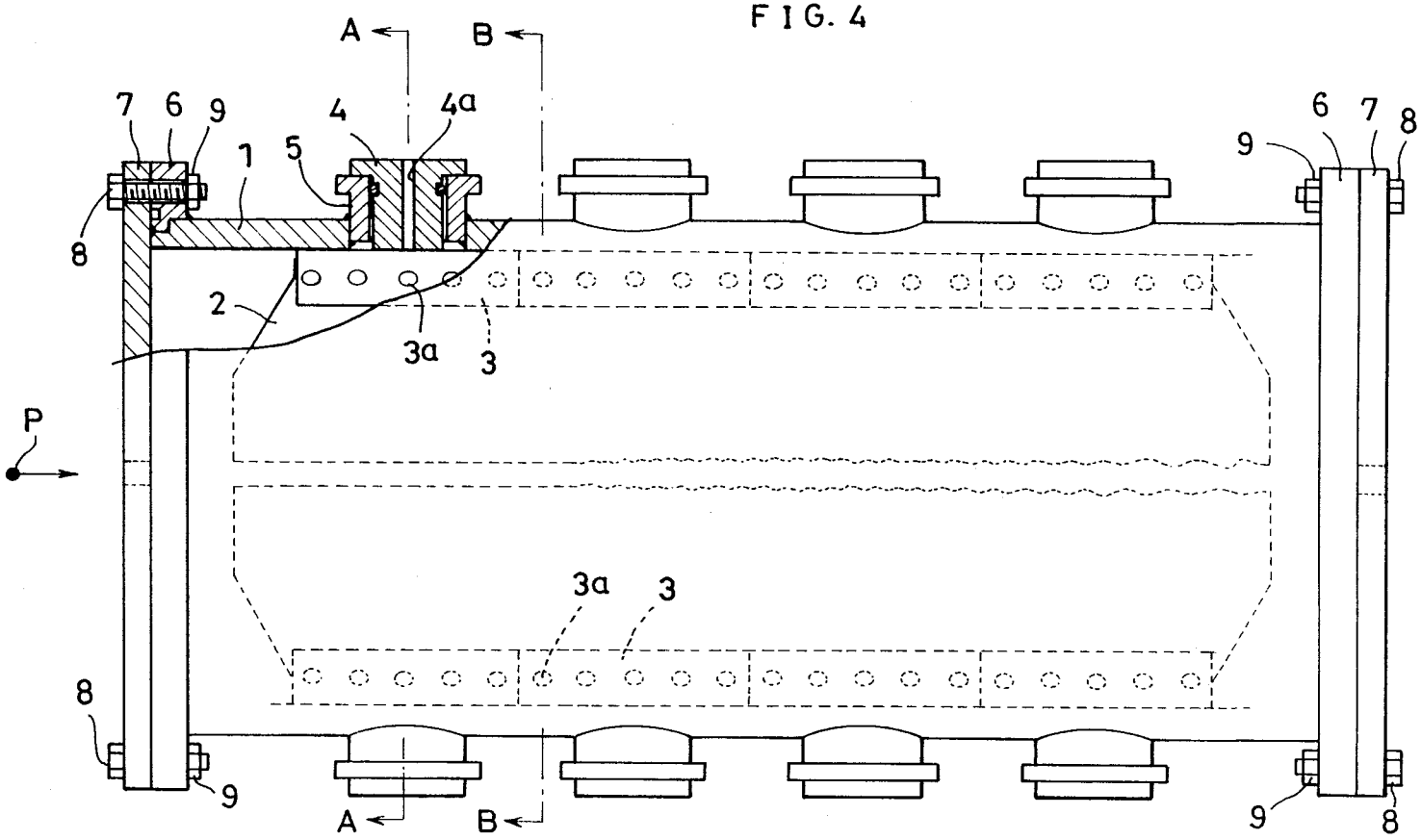
FIG. 4 shows a simplified frontal view of the above first embodiment.

Referring to FIG. 4, which shows a simplified frontal view of an embodiment of the present invention, a cylindrical cavity drum 1 includes therein four electrodes (of which the two lying in the direction perpendicular to the plane of the drawing are omitted, together with the elements related to them and other electrical components such as tuners, to avoid the complexity of the drawing) forming, viewed cross-sectionally, a quadrupole configuration. The cavity drum 1 is provided with flanges 6 on both ends, to which are fixed end plates 7 with bolts 8 and nuts 9. Both the end plates 7 are provided with their respective central through holes through which charged particles P come into or go out from the cavity drum 1 along the centrial axis surrounded by the tips of the four electrodes 2. With such a general constitution of the resonant cavity as a radio frequency qudrupole linear accelerator, each of the four electrodes 4 has its root supported, at regular intervals, in the cavity drum 1, by means of electrode supporting elements 4. The details of electrode supporting means is best illustrated in FIG. 1, which is a partial cross-section taken along a line A—A of FIG. 4.

Figure 3:
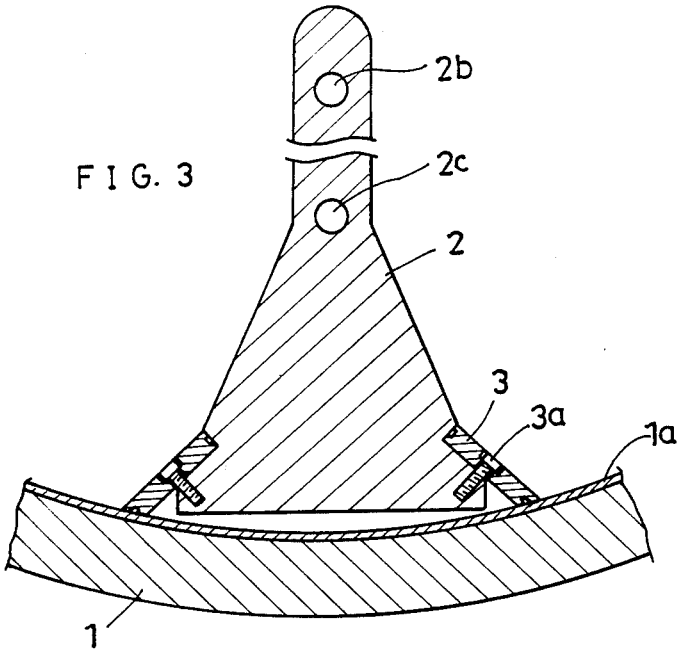
FIG. 3 shows a another partial cross-sectional view of the above first embodiment.

According to FIG. 1, the electrodes 2 is fixed on a electrode supporting element 4 by means of screw bolts 42. The electrode supporting element 4 is inserted in a sleeve element 5 welded to a side hole 1*b* provided on the cavity drum 1. The root portions on both sides of the electrode 2 and the inner surface (plated with a capper layer 1*a*) of the cavity drum 1 are bridged therebetween with contact plates 3 (corresponding to "contact elements" mentioned in "Objects and Summary of the Invention") arranged in series over the whole length of the electrode (refer also to FIG. 4). The contact plates 3 are made connected to the root portions of the electrode 2 by means of screw bolts 3*a* for adjusting the tilt of the electrode 2. The details of the portion related to the contact plates 3 are better illusted in FIG. 2, which is an enlargement of an encircled portion C of FIG. 1. With the above arrangement of the contact plates 3, if the adjusting screw bolt 3*a* on one side is tightened with that on the other side loosened, wedge-shaped clearances, which are left in advance between the contact plates 3 and electrode surfaces 2*d* (represented by one surface 2*d* shown in FIG. 2) facing the contact plates 3, are made repectively narrowed and widened, causing the root of the electrode 2 to be forcibly displaced to the side on which the adjusting screw bolt 3*a* is tightened. The above operation of the fine positional adjustment of the electrode 2 is of cource accompanied by slight distortion of the screw bolts 42 fixing the electrode 2 to the electrode supporting element 4. Since the contact plates 3 are provided over the whole length of any one of the four electrodes 2, the relative positions among the tip portions of all the electrodes 2 can be fine adjusted over the entire path along which charged particles are to be accelerated. Another partial cross-section of the cavity is taken in a plane where the electrode supporting element 4 is not provided, and it is shown in FIG. 3, which corresponds, for example, to the cross-section taken along a line B—B of FIG. 4.

In addition the electric contact between the cavity drum 1 and the four electrodes 2 is not affected by the positional adjustment of the electrodes in substance, because each of the contact plates 3 has its contact edges provided with contact elements 3*b* (FIG. 2) made of an electroconductive elastic material. The elasticity of the contact elements 3*b* secures low electric-resistive stable contact. This electric contact means also is a distinct feature of this embodiment. Incidentally, reference symbols 2*a*, 4*a* in FIG. 1, and 2*b*, 2*c* in FIG. 3 represent water ducts for leading cooling water into the electrode 2.

Figure 5:
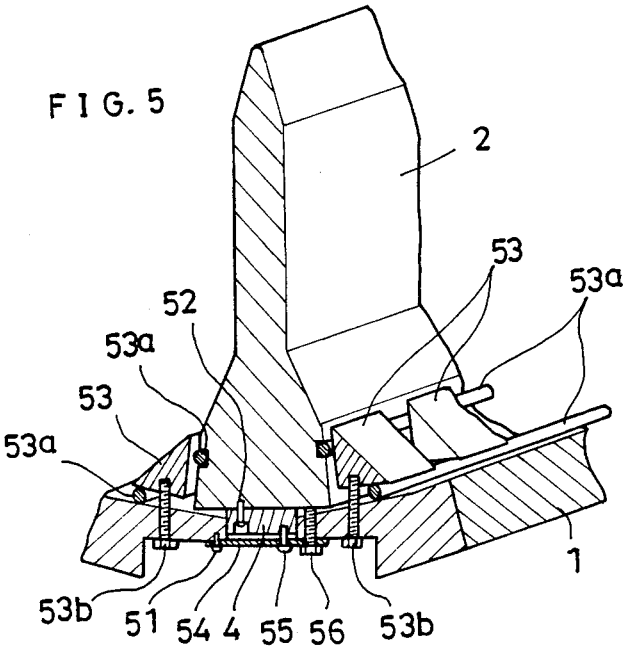
FIG. 5 shows a partial perspective view of a second embodiment of the present invention.

The present invention can be emodied as shown in FIG. 5, which shows a partial perspective view of another embodiment of the present invention. In FIG. 5 the same constituents as those shown in FIG. 1 are given the same reference signs used in FIG. 1.

According to FIG. 5, an electrode supporting element 4 on which an electrode 2 is mounted and fixed with a screw bolt 52 is directly inserted in a hole provided to cavity drum 1 without a sleeve element interposed, but indirectly fixed thereto through a screw bolt 55 connecting the electrode supporting element 4 to a fixing plate 54 which is fixed to the cavity drum 1 with a screw bolt 51. On the other hand the electric contact between the cavity drum 1 and the electrode 2 is mainly effected by contact blocks 53 and contact elements 53*a*. The contact blocks 53 are arranged on both sides of the electrode in series over the whole length of the electrode 2 so that they may electrically connect the root portions on both side of the electrode 2 to the inner surface of the cavity drum 1 through the contact elements 53*a* prolonged over the entire length of the electrode 2.

Figure 7:
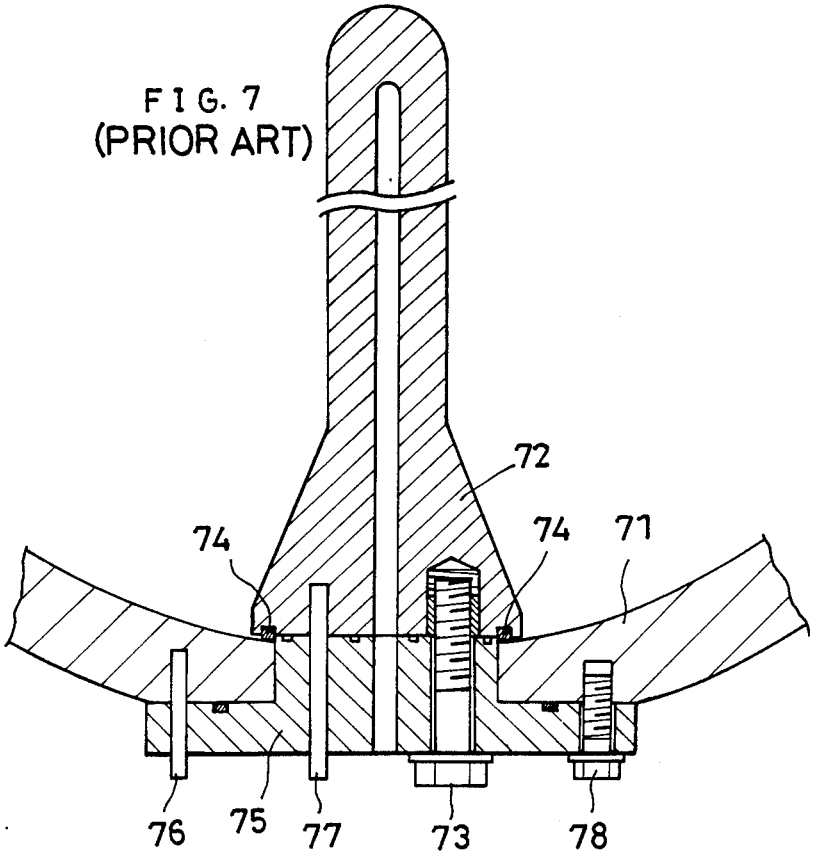
FIG. 7 (PRIOR ART)
FIG. 7 shows a partial cross-sectional view of a conventional radio frequency quadruple linear accelerator.

In this embodiment the tilting of the electrode 2 is effected by pushing up the bottom of the electrode 2 unevenly with an adjusting screw bolt 56 driven. This method of tilting the electrode 2 is equivalent to the conventional method descrived in the beginning on reference to FIG. 7. In this embodiment, however, the influence of the tilting adjustment of the electrode 2 on the condition of the electric contact between the electrode 2 and the cavity drum 1 can easily be corrected by tighting or loosing adjusting screw bolts 53*b* (only two of them can been seen in FIG. 5) connecting the contact blocks 53 to the cavity drum 1.

Figure 6:
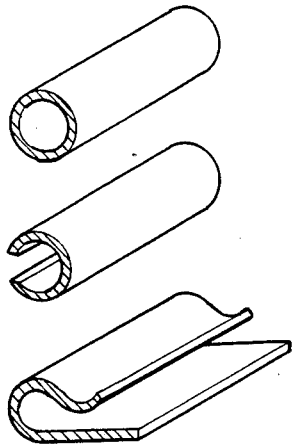
FIG. 6 shows a three examples of the elastic contact elements to be employed in the present invention.

FIG. 6 shows three example of the electroconductive elastic contact elements (3*b* in FIG. 2; 53*a* in FIG. 5) to be used in the present invention.

We claim:

1. A radio frequency multipole linear accelerator substantially made up of a resonant cavity fundamentally consisting of a cavity drum and a plurality of electrodes enclosed therein for accelerating charged particles with the same bunched along the central axis of said resonant cavity, said electrodes being provided with head position adjusting means for fine adjusting the head positions of said electrodes, said radio frequency multipole linear accelerator comprising:

electrode supporting elements for supporting each of said electrodes from below at intervals of a predetermined distance, said electrode supporting elements being inserted in through holes provided along generatrices of said cavity drum;

electrode tilting plates arranged in series along root portions on both side of each of said electrodes so as to slantwise interpose between the inner surface of said cavity drum and said root portions in a brace-like form, said electrode tilting plates being devised so as to generate a force to pull up the bottom on either side of the electrode concernned by tightening screw studs provided to said electrode tilting plates.

2. A radio frequency multipole linear accelerator defined in claim 1, wherein said electrode tilting plates make contact both with the root portions of said electrodes and with the inner surface of said cavity drum through electroconductive elastic contact elements.

3. A radio frequency multipole linear accelerator defined in claim 1 or 2, wherein said through holes provided along generatrices of said cavity drum are provided with their respective sleeve elements for the purpose of making said electrode supporting elements easily detachable.

4. A radio frequency multipole linear accelerator substantially made up of a resonant cavity fundamentally consisting of a cavity drum and a plurality of electrodes enclosed therein for accelerating charged particles with the same bunched along the central axis of said resonant cavity, said electrodes being provided with head position adjusting means for fine adjusting the head positions of said electrodes, said radio frequency multipole linear accelerator comprising:

electrode supporting elements for supporting each of said electrodes from below at intervals of a predetermined distance, said electrode supporting elements being inserted in through holes provided along generatrices of said cavity drum;

electrode tilting screws for tilting each of said electrodes by thrusting up the bottom thereof, said electrode tilting screws penetrating the wall of said cavity drum and reaching the bottom of the electrode concerned; and contact blocks arranged along the root portions on both side of each of said electrodes and made to have contact both with the inner surface of said cavity drum and with the root portions of the electrode concerned through electroconductive elastic contact elements, said contact blocks being devised so as to be pulled downward by externally driving pulling-down screws attached thereto, thereby securing a reliable electric contact between the inner surface of said cavity drum and said contact blocks.

5. A radio frequency multipole linear accelerator defined in claim 1, 2, or 4, wherein said radio frequency multipole linear accelerator is a radio frequency quadrupole linear accelerator.

6. A radio frequency multipole linear accelerator defined in claim 3, wherein said radio frequency multipole linear accelerator is a radio frequency quadrupole linear accelerator.

* * * * *

UNITED STATES PATENT AND TRADEMARK OFFICE

CERTIFICATE OF CORRECTION

PATENT NO. : 4,891,601

DATED : JANUARY 2, 1990

INVENTOR(S) : MASATOSHI ASARI, et al.

It is certified that error appears in the above-identified patent and that said Letters Patent is hereby corrected as shown below:

Title page:

Item (73) Assignee: Change "Shimadzu Corporation, Osaka, Japan" to --Shimadzu Corporation, Kyoto, Japan--

Signed and Sealed this

Twenty-eighth Day of April, 1992

*Attest:*

*Attesting Officer*

HARRY F. MANBECK, JR.

*Commissioner of Patents and Trademarks*